US005249748A

United States Patent [19]

Lacchia et al.

[11] Patent Number: 5,249,748

[45] Date of Patent: Oct. 5, 1993

[54] ELECTROSTATIC SPRAYING INSTALLATION FOR CONDUCTIVE LIQUID COATING PRODUCT

[75] Inventors: Adrien Lacchia, Saint Martin le Vinoux; Pierre Chabert, Crolles; Roger Tholome, Corenc; Thierry Viguier, Meylan, all of France

[73] Assignee: Sames S.A., Meylan, France

[21] Appl. No.: 793,130

[22] Filed: Nov. 18, 1991

[30] Foreign Application Priority Data

Nov. 20, 1990 [FR] France ..... 90 14446

[51] Int. Cl.[5] ..... B05B 5/08; B05B 15/02; B05B 5/16

[52] U.S. Cl. ..... 239/690; 239/112

[58] Field of Search ..... 239/106, 112, 113, 690, 239/691, 703

[56] References Cited

U.S. PATENT DOCUMENTS

| | | | |
|---|---|---|---|
| 4,313,475 | 2/1982 | Wiggins | 141/18 |
| 5,078,168 | 1/1992 | Konieczynski | 239/691 |
| 5,094,389 | 3/1992 | Giroux et al. | 239/690 |

FOREIGN PATENT DOCUMENTS

| | | | |
|---|---|---|---|
| 0394084 | 10/1990 | European Pat. Off. . | |
| 2166982 | 5/1986 | United Kingdom | 239/112 |
| 87/05832 | 10/1987 | World Int. Prop. O. | 239/690 |

*Primary Examiner*—Andres Kasknikow
*Assistant Examiner*—Karen B. Merritt
*Attorney, Agent, or Firm*—Spensley Horn Jubas & Lubitz

[57] ABSTRACT

An electrostatic spraying installation for conductive liquid coating product comprises a circuit for distributing fluids including the conductive coating product. At least one coating product sprayer is fed by this circuit and is connected to a variable or interruptible high voltage supply. At least one insulated auxiliary coating product storage tank is adapted to be raised to the high voltage. The installation includes at least one rinsing product supply and at least one compressed air supply. The circuit comprises at least one mobile member isolator connected between two parts of the distribution circuit to isolate the upstream circuit part from the high voltage. The installation comprises an arrangement of valves on the upstream and downstream sides of the isolator connected to the rinsing product supply and to the compressed air supply for cleaning and purging the isolator before it is opened each time.

15 Claims, 5 Drawing Sheets

ELECTROSTATIC SPRAYING INSTALLATION FOR CONDUCTIVE LIQUID COATING PRODUCT

BACKGROUND OF THE INVENTION

1. Field of the Invention

The invention concerns an electrostatic spraying installation for a conductive liquid coating product such as a water-based paint or a metallic paint. The invention is more particularly concerned with an installation of this kind comprising at least one isolator having a mobile pipe member inserted into the circuit for distributing the coating product to provide the necessary electrical insulation between the parts of the distribution circuit at ground potential and those at a high voltage during spraying of the coating product. The improvement in accordance with the invention enables the operation of an isolator of this kind to be improved and its reliability to be augmented.

2. Description of the Prior Art

Installations of the above kind comprising one or more mobile pipe member isolators for simultaneously interrupting the flow of the coating product and electrically insulating the downstream parts are known. U.S. Pat. No. 4,313,475 describes one such installation in which the isolator is actuated by a ram and comprises two pipe members each provided with a shut-off valve, one of the pipe members being movable towards the other. The valves are opened by opening one of them which causes the other to be opened. A system of this kind is attractive at first sight because both valves can be operated by the ram actuating one valve. However, these systems are not very reliable when conveying conductive liquid coating products such as water-based paints. These coating products are aqueous dispersions of organic resin mixed with solid mineral charges and possibly with metallic pigments. These dispersions are fragile, abrasive and oxidizing, the suspension agent being demineralized water. If the suspension is destroyed, in other words if the aqueous phase is separated from the less fluid resinous phase, the latter adheres to the walls or to the mechanical parts and is much more difficult to clean off. For example, it is then necessary to use a solvent for the resin itself rather than a simple rinsing product such as water. This problem occurs notably in the interstices between the moving parts of an isolator of the kind described above, especially the mating faces, the shut-off balls and their seat. All these parts are quickly soiled and eroded and after some time sealing is lost. It may therefore be necessary to use different cleaning products. One is an inexpensive rinsing product that is not very aggressive, such as water. It is merely capable of entraining and diluting the residues of the coating product. The other, more costly and more aggressive, is a solvent capable not only of rinsing but also of stripping and dissolving residues that have separated out and become deposited on the walls of the pipe and on moving parts.

Another type of electrostatic spraying installation for conductive liquid coating products provides electrical insulation by means of a simple section of insulative pipe, its length being sufficient to "withstand" the high voltage. This pipe section is controlled by valves which admit the coating product to fill the auxiliary storage tank and then the rinsing product and the compressed air to clean the insulative pipe member and to dry it thoroughly so that it is able to function as an electrical insulator. A system of this kind is described in French patent application No 2 572 662, for example. It is difficult to use and requires excessively long cleaning and especially drying cycles which are difficult to control in the automobile industry in which coating product changes are frequent and have to be accomplished in a very short time determined by the rate of production of the objects to be coated.

Finally, in another known type installation electrical insulation is obtained by means of an isolator consisting of an insulative material pipe section inserted into the distribution circuit and provided internally with a mobile scraper member. The displacement of this mobile member cleans the inside wall of said pipe section to make it sufficiently insulative.

The invention embodies a new concept for providing quickly electrical insulation between the two parts of the electrostatic spraying installation. The basic idea of the invention is to use a mobile member isolator but to provide the necessary means in the installation for cleaning and purging the isolator before it is opened each time. Note that cleaning and purging the isolator do not imply complete drying through the prolonged circulation of compressed air. This significantly improves the reliability of a mobile member isolator of this kind without significantly increasing the connection-disconnection times.

SUMMARY OF THE INVENTION

The present invention consists in an electrostatic spraying installation for conductive liquid coating product comprising a circuit for distributing fluids including said conductive coating product, at least one coating product sprayer fed by said circuit and connected to a variable or interruptible high voltage supply, at least one insulated auxiliary coating product storage tank adapted to be raised to said high voltage, at least one rinsing product supply and at least one compressed air supply, said circuit comprising at least one mobile member isolator connected between two parts of said distribution circuit to isolate an upstream circuit part from said high voltage and said installation comprising an arrangement of valves on the upstream and downstream sides of said isolator connected to said rinsing product supply and to said compressed air supply for cleaning and purging said isolator before it is opened each time.

The expression "mobile member isolator" is intended to mean both an isolator having a mobile pipe member and an isolator having a scraper, these two types of isolator being known in themselves and described above.

The isolator or isolators of the installation is/are therefore cleaned and purged with a specific arrangement of valves establishing communication with supplies of rinsing product and/or solvent, recovery means enabling the purging, a supply of compressed air for carrying out the purging, etc. The valves of this kind are conventional and embody very many years experience. They are less costly and more reliable than the special valves of a mobile pipe member isolator. Such isolators wear much more slowly because they are never operated in the presence of the abrasive coating product. Some isolators may even be simplified to the point where they no longer comprise any shut-off valve.

In some installations it is even possible to group together a plurality of isolators combined in a single structure provided with common actuator means operating them simultaneously. With a structure of this kind it is easier to monitor the opening or closing of all the isolators using a single pair of position sensors associated with the mobile assembly common to them.

As will be explained later, the concept of the invention is applicable to electrostatic spraying installations for very different conductive liquid coating products. It applies in particular to an installation enabling frequent and fast changes of coating product and comprising an upstream auxiliary storage tank which is grounded and coupled to a coating product change unit and a downstream auxiliary storage tank which is selectively raised to the high voltage, means including an isolator of this kind being provided between the two storage tanks to transfer very quickly a quantity of coating product from the upstream storage tank to the downstream storage tank.

The invention applies also to an electrostatic spraying installation for a coating product that is designed to operate continuously with the same coating product for long periods. An installation of this kind comprises an upstream distribution circuit part which is grounded at all times, a downstream distribution circuit part selectively raised to the high voltage and comprising an auxiliary storage tank and an intermediate circuit part also comprising an auxiliary storage tank between said upstream and downstream circuit parts and adapted to be selectively grounded or raised to the high voltage. The various parts of the distribution circuit are coupled to each other by mobile pipe member type isolators and comprise the valves needed for implementing the invention.

Finally, the invention is also suitable for installations in which the distribution circuit comprises two similar branches in parallel interconnected by valves between at least one supply of coating product and the sprayer(s), each branch comprising an insulated auxiliary storage tank interconnected by valves between an upstream isolator coupled to said coating product supply which is grounded and a downstream isolator coupled to said sprayer which is raised to the high voltage during spraying.

The invention will be better understood and other advantages of the invention will emerge more clearly from the following description of a number of installations in accordance with the invention given by way of example only and with reference to the appended diagrammatic drawings.

DETAILED DESCRIPTION OF THE INVENTION

Figure 1:
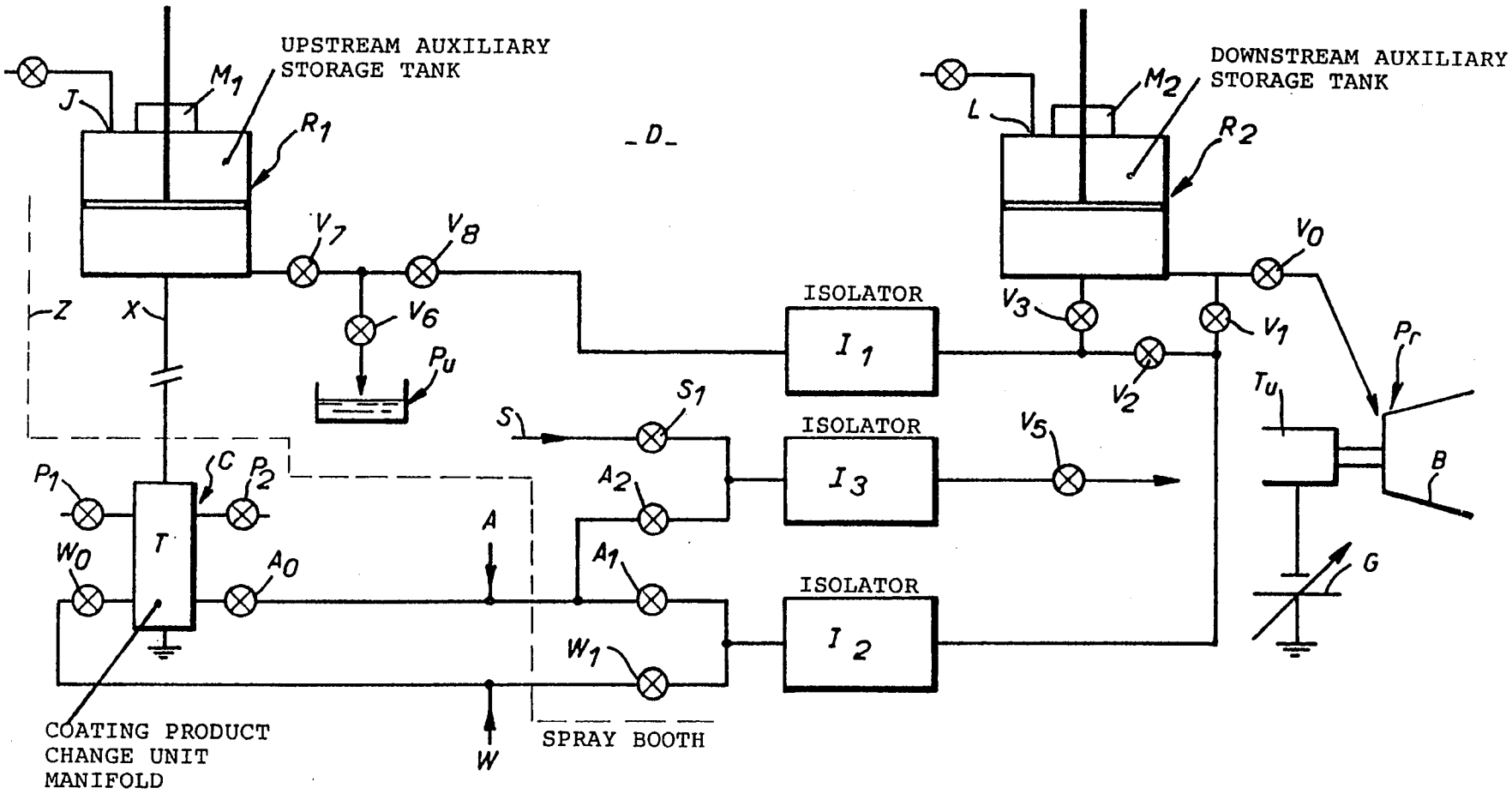
FIG. 1 is a block diagram of an electrostatic spraying installation for conductive liquid coating product incorporating improvements in accordance with the invention.

FIG. 1 shows an electrostatic spraying installation for conductive liquid coating product comprising a coating product change unit C disposed outside a spray booth Z and connected by a pipe X to the bottom of an upstream auxiliary storage tank R1 which is part of a coating product distribution circuit D. This is disposed inside the spray booth Z and also comprises a set of valves that will be described in detail later, an insulated downstream auxiliary storage tank R2, and three isolators I1, I2, I3 which may be of the known type described above and are preferably as shown in FIG. 3. The sprayer Pr is of the type comprising a spray bowl B rotated at high speed by a turbine Tu. The sprayer bowl B is raised to a high voltage by a variable or interruptible voltage generator G. In the known manner, the sprayer comprises a coating product injector which deposits said coating product onto the inside surface of the bowl B so that it is divided into fine droplets by centrifugal force. The injector is connected to an outlet of the storage tank R2 through a valve V0. The pipe X feeding the storage tank R1 may be around ten meters long whereas the other connections defining the distribution circuit inside the booth do not exceed a length of a few tens of centimeters. The coating product change unit C conventionally comprises a number of valves connected to circuits feeding respective fluids and all discharging into a manifold T which is grounded for safety reasons. The figure shows two valves P1, P2 for different coating products connected to respective feed circuits (not shown) of two different color coating products, a valve W0 connected to a supply W of rinsing product such as water and a valve A0 connected to a supply A of compressed air. The storage tank R1 is of a known type incorporating a piston actuated by compressed air applied to an inlet J. Movement of the piston is monitored by a sensor M1 so that the quantity of coating product in the storage tank R1 is known at all times. The storage tank R2 is of the same design with an air inlet L and a displacement sensor M2 associated with the piston.

The outlet of the storage tank R1 is fitted with an outlet valve V7 connected to a valve V6 connected to purge means Pu. The outlet of the valve V7 is also connected to a valve V8 connected to one end of an isolator I1 The other end of the isolator I1 is connected to the bottom of the storage tank R2 by a valve V3.

A second isolator I2 is supplied with compressed air through a control valve A1 connected to the supply A and a rinsing product through a valve W1 connected to the rinsing product supply W. The other end of the isolator I2 is connected to the outlet of the storage tank R2, upstream of the valve V0, by a valve V1. This same end of the isolator I2 is connected to the common point of the isolator I1 and of the valve V3 by a valve V2. The installation further comprises a third isolator I3 connected at one end to an outlet of the compressed air supply A by a valve A2 and to a solvent supply S by a valve S1 and connected at the other end to cleaning means for the bowl B (not shown) by a valve V5. As explained above, this solvent is a product capable of dissolving residues of the coating product. It is more costly and more aggressive than the rinsing product (which may be water) but it is used only for cleaning the bowl B.

Figure 3:
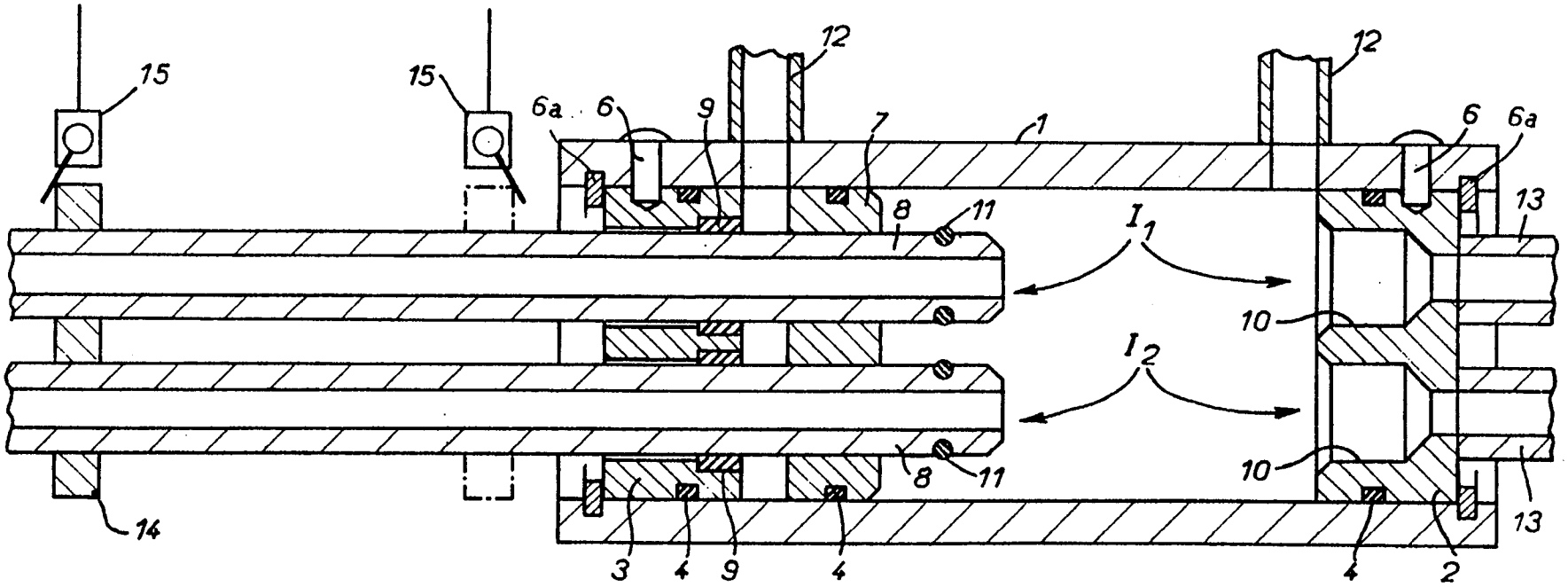
FIG. 3 is a detail view showing the isolators from the FIG. 1 installation.

FIG. 3 shows one form of the set of isolators I1, I2 and I3 adapted to be operated together, as will be explained later. The system comprises a cylinder 1 fitted at one end with a receiver end-piece 2 and at the other end with a guide end-piece 3. The end-pieces 2 and 3 are sealed by O-rings 4, prevented from rotating by pins 6 and prevented from moving in translation by circlips 6*a*. A piston 7 slides inside the cylinder 1, to which it is sealed by another O-ring 4. The piston 7 carries three rigid fluid transporter tubes 8, only two of which can be seen in the figure, which can slide in the guide end-piece 3, to which they are sealed by packing 9. The ends of the rigid tubes are adapted to enter recesses 10 in the receiver end-piece 2. The coupling is sealed by O-rings 11 at the ends of the tubes 8. Two compressed air feed pipes 12 operate the piston and therefore displace the three sliding tubes 8 simultaneously to connect the ends of these tubes to the corresponding recesses 10 of the end-piece 2 which are extended by pipes 13. Each combination of a tube 8 and a recess 10 forms one isolator as defined above, of course. Outside the cylinder 1 the tubes 8 are secured by a flange 14 which operates end of travel switches 15 which confirm that the isolators have been completely connected or disconnected. Note that in this embodiment none of the three isolators has a shut-off valve. The isolators are therefore as simple as possible. By virtue of the concept of the invention, however, they are nevertheless usable in an installation as described with reference to FIG. 1. This simplified structure is particularly advantageous for the isolator I1 which periodically transfers coating product from the storage tank R1 to the storage tank R2.

The operation of the system is as follows:

Referring to FIGS. 1 and 3, consider the following initial situation. The three isolators are clean, empty (but not necessarily dry) and open, the latter being confirmed by one of the switches 15. The storage tank R1 has the minimum volume but is soiled by residue of a first coating product (previously dispensed through the valve P1 and transferred into the full storage tank R2). All the valves are closed except for the valve V6 and the voltage generator G is switched out. The installation is thus ready to paint an object with the first coating product. Painting is started by opening the valve V0 to enable flow at a flowrate monitored by the sensor M2. Throughout spraying the voltage generator G applies a high voltage to the sprayer. During this time the storage tank R1 and the manifold T are cleaned by opening the valve V7 and carrying out a cleaning sequence which consists in injecting successively and alternately quantities of rinsing product and compressed air by operating the valves W0 and A0. The cleaning sequence ends with injection of air through the valve A0 to clear the pipes of the rinsing product. It is not necessary to dry them completely, however.

The second coating product is fed into the manifold as far as the inlet of the storage tank R1 by closing the valve A0 and opening the valve P2. When the second coating product reaches the storage tank R1 the valve V7 is closed.

Filling of the storage tank R1 is monitored by the sensor M1. When a predetermined quantity of the coating product is in the storage tank R1 the valve P2 is closed.

When an object has been painted completely with the first coating product the storage tank R2 has the minimum volume and contains only traces of this coating product. The voltage generator G is then switched out and the storage tank R2 and the sprayer are cleaned by closing all the isolators I1, I2, I3 under the control of the other end of travel switch 15 (FIG. 3). The valves V1, V3 and V8 are opened and a cleaning sequence of the same type as described above is carried out by operating in succession the valves A1 and W1, the effect of which is to clean simultaneously the injector through the valve V0 and the storage tank R2, the soiled rinsing product being conveyed to the purge means Pu through the isolator I1. When the injector is clean and empty the valve V0 is closed and cleaning of the storage tank R2 continues. At the same time, the bowl B is cleaned by a specific cleaning sequence using the solvent supplied through the isolator I3. The valve V5 is opened and the valves A2 and S1 operated in succession. The isolators I1, I2 and I3 are purged on completing the above-defined cleaning sequences by injecting sufficient amounts of air after the final closing of the valves W1 and S1.

From this time all of the distribution circuit D is clean and empty except for the storage tank R1 which is filled with the necessary quantity of the second coating product. This coating product is transferred into the storage tank R2 by closing the valves A1, A2, V1, V5 and V6 and opening the valve V7 (the valves V3 and V8 are already open). The transfer is accomplished in a very short time by applying air at high pressure at J. The storage tank R1 then has the minimum volume and contains traces of the second coating product whereas the storage tank R2 has the maximum volume and is full of this product.

The valves V3, V7 are closed and the isolator I1 is cleaned by opening the valves V2 and V6 and carrying out a further cleaning and purging sequence using the valves A1 and W1. On completion of this sequence all parts of the distribution circuit downstream of the storage tank R1 are clean and the valves V2 and V8 are closed. All the isolators are then opened simultaneously under the control of one of the end of travel switches 15. This returns the system to the initial situation except that the second coating product has been substituted for the first.

Note that the isolators are actuated only when clean and purged. They do not need to be completely dry, however, because electrical insulation is obtained by the displacement of the pipe members 8. The isolators can be extremely simplified (FIG. 3) as compared with those routinely used which incorporate valves at the ends where they join. By virtue of the invention, these valves are no longer indispensable. Nevertheless, if they are retained for increased safety there is no longer any risk of clogging or premature wear because the isolators are actuated only in the absence of the coating product.

Figure 2:
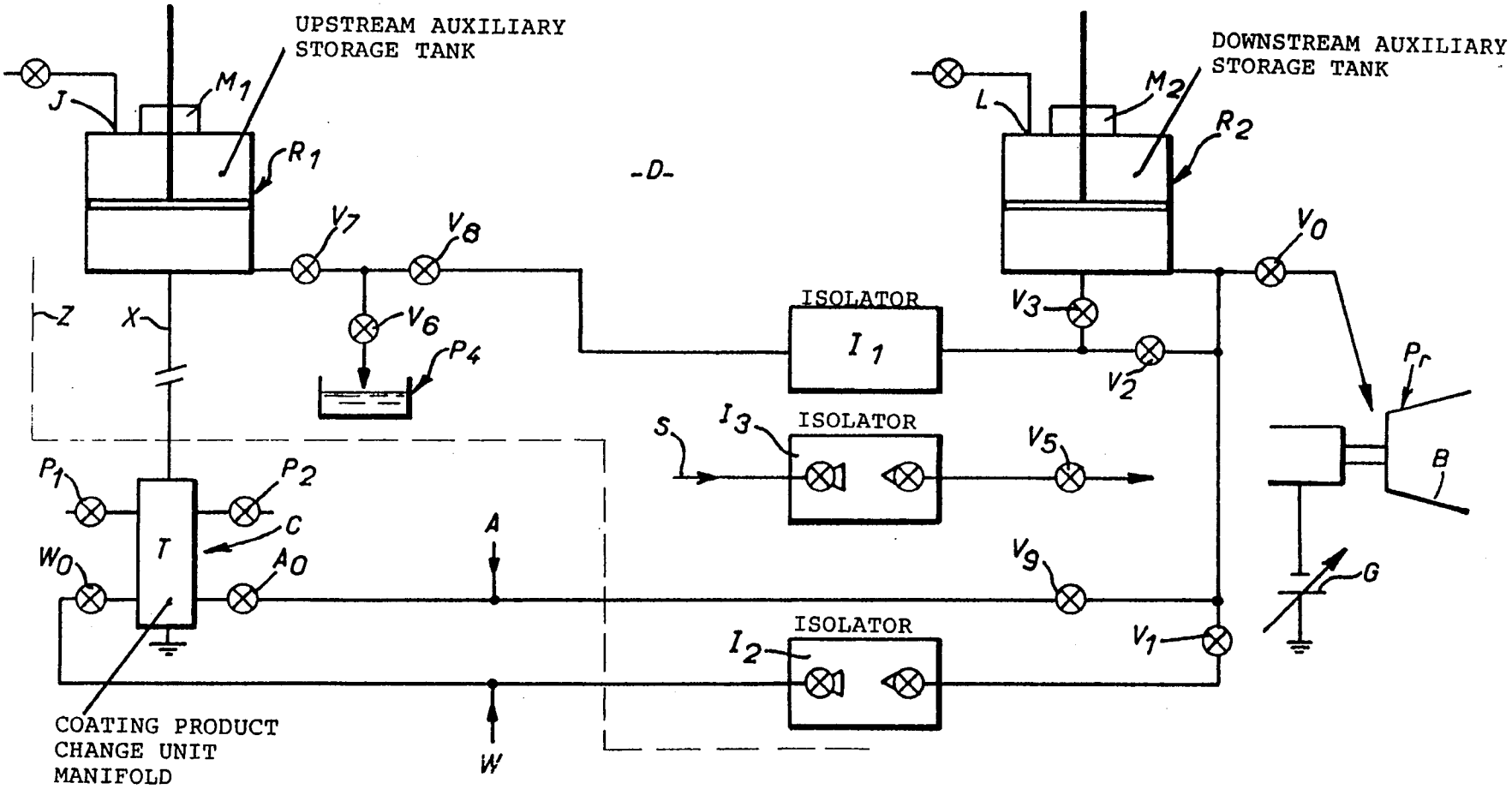
FIG. 2 is a block diagram similar to that of FIG. 1 showing an alternative embodiment of the installation.

The above description of the operation of the installation shows that only the isolator I1 conveys the coating product or a liquid containing coating product. It is therefore not indispensable to clean and purge the isolators I2 and I3 which are not in contact with abrasive fluids. In this case, these two isolators can be of the conventional type with valves at the ends, which makes it possible to eliminate a number of valves in the distribution circuit and to economize on cleaning products each time the isolators are connected-disconnected. The installation is then as shown in FIG. 2 which shows an alternative embodiment of the FIG. 1 installation in which similar structural parts carry the same reference symbols and will not be described again. The differences relate to the isolators I2 and I3 which are self-closing isolators with valves at the ends. On the high voltage side the isolator I3 is connected to the bowl cleaning means through the valve V5 as previously. At the other end, this isolator is connected directly to the solvent supply S. The valve V2 is connected directly to the outlet of the storage tank R2. The compressed air supply A is connected to a valve V9 which is also connected to the outlet of the storage tank R2. The isolator I2 is connected as previously to the valve V1 at the high voltage end and is connected directly to the rinsing product supply W at the other end.

The operation of the system is as follows:

Consider the following initial situation. The isolators I1, I2 and I3 are open. The isolator I1 is clean and purged. The isolators I2 and I3 are not, but their valves are closed. The storage tank R1 has the minimum volume and is soiled with residues of the first coating product. The storage tank R2 has the maximum volume and is full of the same product. All of the valves are closed except for the valve V6 and the voltage generator G is switched out.

Painting is begun by opening the valve V0 and switching in the voltage generator G. The flowrate of the coating product is monitored by the sensor M2. During this time the storage tank R1 and the manifold T are cleaned by opening the valve V7 and carrying out a cleaning and purge cycle using the valves A0 and W0, as previously.

When the storage tank R1 and the manifold T are cleaned and purged the second coating product is fed into the manifold T and into the storage tank R1 by opening the valve P2, the valves A0 and W0 being closed. When the second coating product reaches the storage tank R1 the valve V7 is closed. The storage tank R1 begins to fill, filling being monitored by the sensor M1. When the required quantity of coating product has been fed into the storage tank R1 the valve P2 is closed.

On completion of painting with the first coating product the storage tank R2 is at the minimum volume. The voltage generator G is then switched out.

The valve V0 is closed and the isolators I1, I2 and I3 are closed simultaneously. The valves V3, V8 and V9 are opened which evacuates excess coating product from the storage tank R2. This storage tank is then cleaned at the same time as the isolator I1 by carrying out a cleaning and purge sequence using the valves V1 and V9. The bowl B is cleaned at the same time by opening the valve V5.

The injector is cleaned by closing the valve V3 and opening the valve V0.

When the storage tank R2 and the isolator I1 are clean they are purged by injecting air and the valves V0, V5 and V9 are closed. This cleaning and purge sequence is slightly different than that described with reference to FIG. 1 but is equally effective.

From this time all of the distribution circuit is cleaned and purged except for the storage tank R1 which is full of the second coating product. This is transferred into the storage tank R2 by closing the valve V6 and opening the valves V7 and V3.

When transfer is completed the storage tank R1 is at the minimum volume and is soiled with residues of the second coating product. The storage tank R2 is at the maximum volume and is filled with the same coating product. The valves V3 and V7 are closed and the isolator I1 is cleaned by opening the valves V2 and V6 and carrying out a further cleaning and purge sequence using the valves V1 and V9.

The isolators I1, I2 and I3 are then opened. This returns the system to the initial situation except that the second coating product has been substituted for the first.

Figure 4:
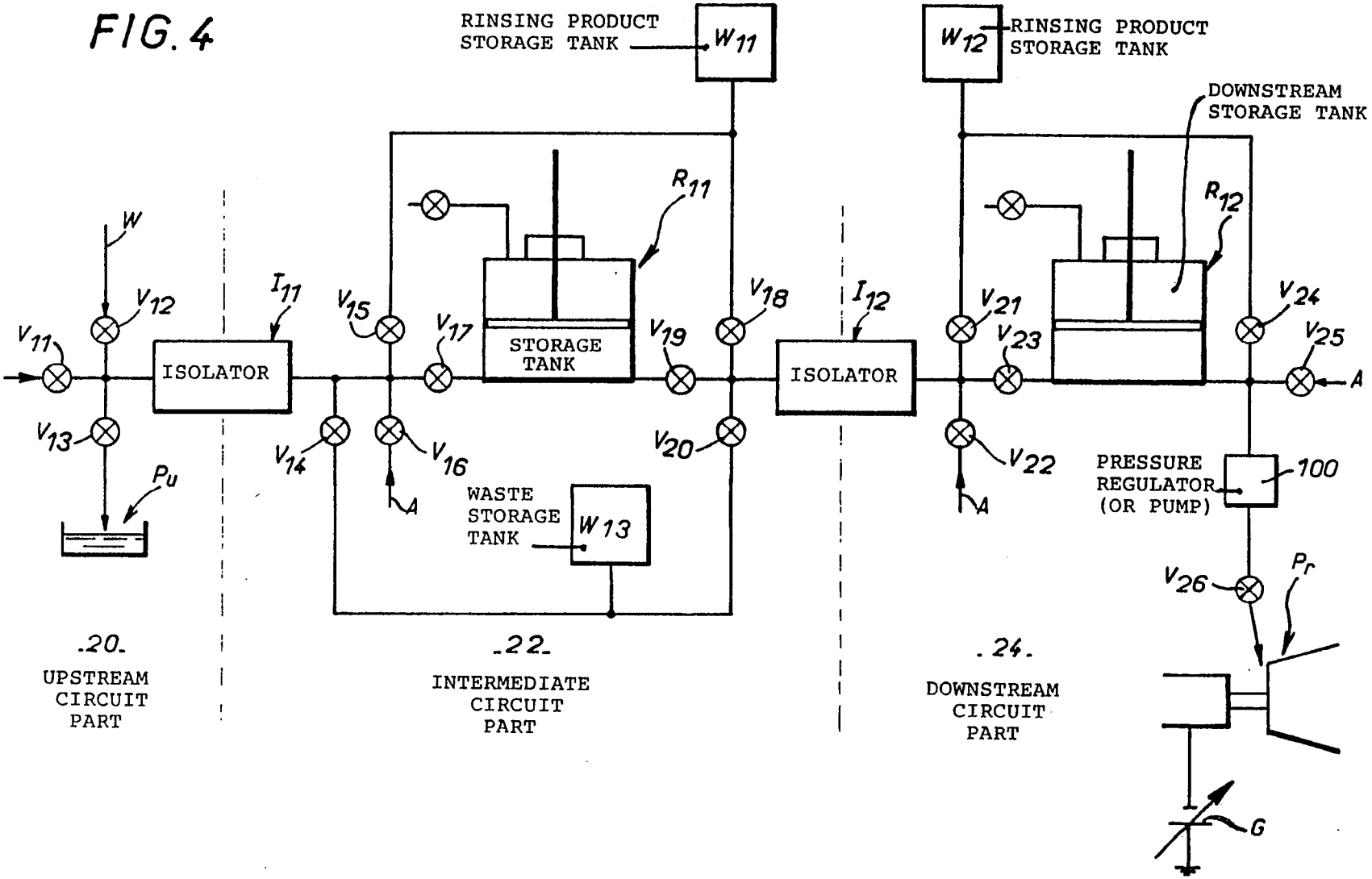
FIG. 4 is a block diagram of another installation embodying the invention enabling continuous spraying of the coating product.

FIG. 4 shows an installation with two auxiliary storage tanks in series adapted to apply a conductive coating product continuously for long periods. The installation can be designed for a single coating product or for a plurality of coating products delivered by a coating product change unit (not shown) on the upstream side of the installation. A coating product is fed into the distribution circuit by a valve V11 from which it is fed to the injector of the sprayer Pr through a valve V26. Between the valve V11 and the sprayer the distribution circuit comprises three circuit parts: an upstream circuit part 20 which is permanently grounded and includes the valve V11, a downstream circuit part 24 which is at the high voltage when the voltage generator G is switched in and comprises a downstream storage tank R12, and an intermediate circuit part 22 comprising a storage tank R11 and connected to said upstream circuit part 20 by an upstream isolator I11 and to said downstream circuit part 24 by a downstream isolator I12.

In this example the storage tanks R11 and R12 are similar to the coating product storage tanks used in the FIG. 1 and 2 installations. The isolators I11 and I12 are also of the same kind as those of the installations described previously, with or without shut-off valves.

The upstream circuit part 20 comprises a valve V12 connected to a rinsing product supply W and a valve V13 connected to purge means Pu. The three valves V11, V12 and V13 are connected to the same end of the isolator I11.

If the installation is designed to apply different coating products a coating product change unit similar to that from FIG. 1 may be added to the upstream circuit part 20 and connected to the inlet of the valve V11.

The other end of the isolator I11, on the intermediate circuit part 22 side, is connected to a rinsing product storage tank W11 by a valve V15 and to a waste storage tank W13 by a valve V14. It is also connected to an inlet at the bottom of the storage tank R11 by a valve V17. The outlet of the storage tank R11 is connected to one end of the isolator I12 by a valve V19. The storage tanks W11 and W13 are also connected to the isolator I12 by respective valves V18 and V20. A compressed air supply A is connected to the common point of the valves V14, V15 and V17 by a valve V16.

The other end of the isolator I12, on the downstream circuit part 24 side, is connected to a rinsing product storage tank W12 by a valve V21, to the compressed air supply A by a valve V22 and to the inlet of the storage tank R12 by a valve V23. The outlet of the storage tank R12 is connected to the storage tank W12 by a valve V24 and to the compressed air supply A by a valve V25. As previously, this outlet feeds the injector of the sprayer Pr through the valve V26.

The volumes of coating product contained in the storage tanks R11 and R12 are monitored in the same way as in the FIG. 1 and 2 installations. A pressure regulator 100 or a positive displacement pump inserted into the injector pipe can be used to monitor the flowrate of the sprayed product irrespective of variations in pressure in the storage tank R12 because of its being filled during spraying. On the other hand, the rinsing product or waste storage tanks W11, W12, W13 can be of simpler design, with no separator piston. A storage tank of this kind may simply comprise a liquid inlet-outlet orifice in its lower part and an air inlet-outlet orifice in its upper part, the liquid being expelled by injecting compressed air.

The operation of the system is as follows: assume that the installation is applying a given coating product contained in the storage tank R12 which is at the high voltage because the voltage generator G is switched in. The problem is to fill the reservoir R12 without interrupting application of the coating product. In this initial state the voltage generator G is therefore switched in, all the valves are closed except for the valve V26, the two isolators I11 and I12 are open and cleaned, the two storage tanks R11 and R12 are filled with coating products and the two storage tanks W11 and W12 are filled with rinsing product, the storage tank W13 being empty.

When the storage tank R12 is almost empty the isolator I12 is closed with the result that the high voltage is applied to the intermediate circuit part 22. The valves V19 and V23 are opened to allow the storage tank R12 to be filled with the coating product contained in the storage tank R11.

When the storage tank R12 is full the storage tank R11 is empty. The valves V19 and V23 are closed and the valves V20 and V21 are opened so that the isolator I12 can be cleaned with the rinsing product contained in the storage tank W12. The rinsing product charged with the coating product accumulates in the storage tank W13.

When the storage tank W12 is empty, it is filled with the rinsing product contained in the storage tank W11 by closing the valve V20 and opening the valve V18, the valve V21 being open already.

It is then necessary to purge the rinsing product from the isolator I12 by closing the valves V18 and V21 an opening the valves V20 and V22. The compressed air expels the residual rinsing product contained in the isolator I12 towards the storage tank W13.

The valves V20 and V22 are closed. From this time the isolator I12 is cleaned and purged. It can therefore be opened so that the circuit part 22 is again isolated from the high voltage. In this part of the circuit the storage tank W13 is full of soiled rinsing product and the storage tank W11 is empty.

The storage tank R11 must be refilled with coating product and the storage tank W11 must be refilled with rinsing product by closing the isolator I11. The intermediate circuit part 22 is therefore grounded. The valves V12 and V15 are opened so that the storage tank W11 fills with the rinsing product.

The valves V12 and V15 are closed and the valves V13 and V16 opened. The compressed air purges the isolator I11 of the rinsing product that it contains and expels it towards the purge means Pu.

The storage tank R11 is refilled with coating product by closing the valves V13 and V16 and then opening the valves V11 and V17.

When the storage tank R11 is full the valves V11 and V17 are closed. It is also necessary to empty the storage tank W13 by opening the valves V13 and V14. The storage tank W13 empties into the purge means Pu through the isolator I11.

The isolator I11 is cleaned using the rinsing product contained in the storage tank W11 by closing the valve V14 and opening the valve V15, the valve V13 being open already.

The storage tank W11 is then filled with the rinsing product by closing the valve V13 and opening the valve V12, the valve V15 being open already.

The valves V12 and V15 are closed. The isolator I11 is purged of the rinsing product that it contains by opening the valves V13 and V16. When the isolator I11 is purged by the compressed air in this way is possible to open it after closing the valves V13 and V16. This returns the system to the initial state described above without interrupting spraying of the coating product and actuating the isolators I11 and I12 only when they are clean and purged.

The sequence for filling the storage tank R11 and draining the storage tank W13 can be slightly simplified if the rinsing product storage tank W11 is slightly bigger. It is then unnecessary to fill it at the start of the sequence or to purge the isolator I11 after it. The simplified sequence is then: isolator I11 empty, clean and closed:

The valves V11 and V17 are opened, the storage tank R11 is filled, the valves V11 and V17 are closed.

The valves V13 and V14 are opened, the storage tank W13 is drained, the valve V14 is closed.

The valve V15 is opened, the isolator I11 is cleaned with the rinsing product remaining in the storage tank W11, the valve V13 is closed.

The valve V12 is opened, the storage tank W11 is filled, the valves V12 and V15 are closed.

The valve V16 is opened, the isolator I11 is purged, the valves V13 and V16 are closed.

This represents five operations instead of seven and 15 valve actuations instead of 24. The clean and empty isolator can then be opened.

Note that it is not necessary to have much more rinsing product in the storage tank W11 because the cleaning that remains to be carried out follows on from the passage of the very diluted product from the storage tank W13.

To change the coating product it is necessary to switch out the high voltage generator G and to stop spraying. A cleaning cycle may be carried out using the same structural members as described. The valve V25 controls the entry of compressed air at the downstream side of the storage tank R12 for purging the storage tanks R11 and R12 and the isolators I11 and I12 into the purge means, the valve V13 being opened, while they are cleaned either in the same direction with the rinsing product contained in the storage tanks W11 and W12 or in the reverse direction including expulsion from the sprayer, the valve V12 being then opened.

Figure 5:
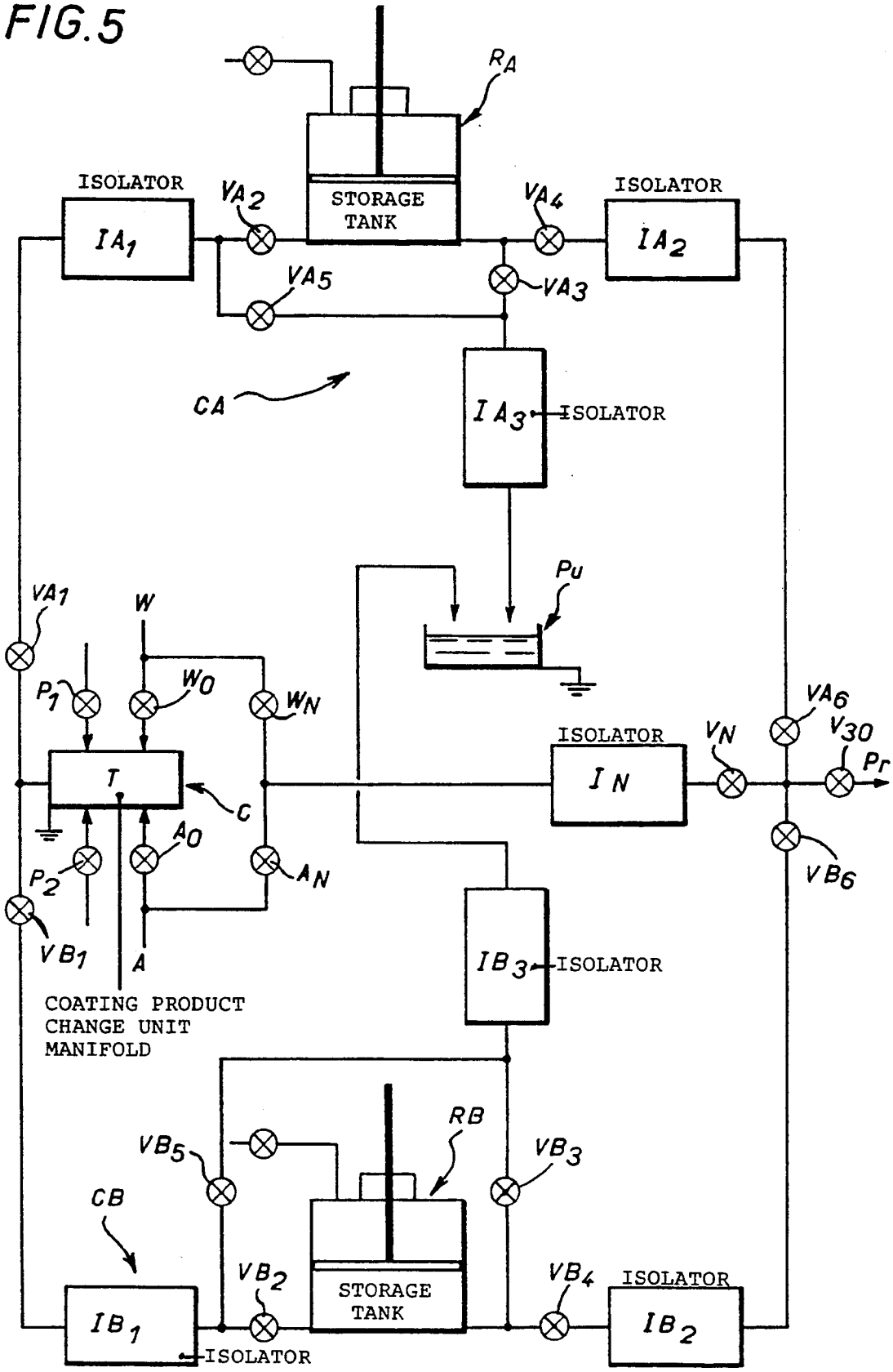
FIG. 5 is a block diagram of another installation for spraying coating product enabling fast coating product changes and comprising two distribution circuit branches in parallel, each branch embodying the invention.

In the FIG. 5 installation the distribution circuit links at least one supply of coating product, in this example a coating product change unit C, and the sprayer Pr (not shown). In a manner that is known in itself it comprises two similar branches CA, CB in parallel interconnected by valves to said coating product change unit and to the injector of said sprayer connected to a valve V30. Each branch comprises an insulated storage tank RA or RB interconnected by valves between an upstream isolator IA1 or IB1 connected to the coating product change unit C and a downstream isolator IA2 or IB2 connected to the sprayer Pr. In more detail, the branch CA comprises a valve VA1 interconnected between the outlet of the manifold T of the coating product change unit and one end of the isolator IA1, a valve VA2 connected between the other end of the isolator IA1 and the inlet of the storage tank RA, a valve VA4 connected between the outlet of the storage tank RA and one end of the isolator IA2 and a valve VA6 connected between the other end of the isolator IA2 and the valve V30. At the storage tank RA end, the isolator IA1 is connected by a valve VA5 to a purge isolator IA3 and the outlet of the storage tank RA is connected by a valve VA3 to the same purge isolator, at the same end as the valve VA5. The other end of the purge isolator IA3 is connected to purge means Pu which are grounded.

The arrangement is the same in the branch CB. The outlet of the manifold T is connected by a valve VB1 to the upstream isolator IB1 whose other end is connected to the storage tank RB by a valve VB2 and to the purge isolator IB3 by a valve VB5. The outlet of the storage tank RB is connected by a valve VB3 to the same purge isolator and to the same downstream isolator IB2 by a valve VB4. The other end of the downstream isolator IB2 is connected to the valve V30 by a valve VB6. A rinsing product supply W is connected by a valve WN to a cleaning isolator IN and a compressed air supply A is connected by a valve AN to the same cleaning isolator at the same end as the valve WN. The other end of the isolator IN is connected by a valve VN to the common points of the valves VA6, VB6 and V30.

The color change unit C is identical to that from FIGS. 1 and 2. It comprises coating product inlet valves P1, P2 connected to the manifold T and connected to different coating product feed circuits (not shown). A valve W0 connected to the rinsing product supply W and a valve A0 connected to the compressed air supply A are also connected to the manifold T. The operation of the system is as follows:

Assume that in the initial situation under consideration all of the distribution circuit shown is clean and empty and that the isolators are open. The storage tank RA is filled with the first coating product by opening the valves P1, VA1, VA2 and VA3, the isolators IA1 and IA3 being closed. When the coating product reaches the storage tank RA, the valve VA3 is closed and the storage tank is filled by displacement of the piston. When the storage tank RA is full of the first coating product the valves P1 and VA2 are closed and the valve VA5 is opened. A cleaning and purge sequence of the kind described above is then carried out by operating the valves W0 and A0 alternately. When the isolators IA1 and IA3 and the manifold T are clean and purged they are opened. The valve VA5 is then closed.

The isolator IA2 is then closed. The coating product contained in the storage tank RA can then be used by opening the valves VA4, VA6 and V30.

During this time the storage tank RB is filled with the second coating product by opening the valves P2, VB1, VB2 and VB3 and closing the isolators IB1 and IB3 until the coating product reaches the inlet of the storage tank RB. The valve VB3 is then closed to fill the storage tank.

When the storage tank RB is full, the manifold T and the isolators IB1 and IB3 are cleaned and purged in the same way as described with reference to the branch CA. When this operation is completed the valves VB1 and VB2 are closed and the isolators IB1 and IB3 are open so that the branch CB is ready for use.

When coating of an object with the first coating product has been completed, the injector and the isolator IA2 must be closed by closing the valve V30, closing the isolators IN and IA3 and opening the valve VA3. A cleaning sequence is then carried out by operating the valves AN and WN alternately. This cleaning is completed by purging the isolators IA2 and IA3 by injecting air through the valve AN. The valve VA6 is then closed and the valve V30 is opened briefly to clean the injector after which it is closed again. The valves WN, AN, VN and VA4 are then closed and the isolator IN and the isolator IA2 are then opened. It remains to clean the storage tank RA.

At this time it is possible to begin painting with the second coating product contained in the storage tank RB by closing the isolator IB2 and opening the valves VB4, VB6 and V30.

During this time the storage tank RA is cleaned by closing the isolator IA1 and opening the valves VA1, VA2. A cleaning cycle is carried out by operating alternately the valves W0 and A0.

When the storage tank RA is cleaned and purged, the valves A0 and W0 are closed and the storage tank RA is filled with the first coating product by opening the valve P1 or with another product if the manifold can be fed by a greater number of circuits for circulating different coating products.

The circuit CA has therefore been returned to the initial state during completion of application of the second coating product by means of the circuit CB.

Of course, the sprayer Pr is raised to a high voltage during spraying by an electric generator (not shown) and is grounded while changing the product to be sprayed.

There is claimed:

1. Electrostatic spraying installation for spraying a conductive liquid coating product, said installation being operable in cooperation with waste recovery means and said installation comprising a circuit for distributing fluids including said conductive coating product, at least one coating product sprayer fed by said circuit and connected to a high voltage supply, at least one insulated auxiliary coating product storage tank adapted to be raised to a high voltage, at least one rinsing product supply and at least one compressed air supply, said circuit comprising an upstream circuit part, a downstream circuit part connected to said sprayer and to said at least one auxiliary coating product storage tank, and at least one isolator having an upstream side connected to said upstream circuit part and a downstream side connected to said downstream circuit part, said isolator having a part which is movable to place said isolator in an isolating state for electrically isolating said upstream circuit part from said downstream circuit part, and said installation further comprising first valve means connected to said upstream side of said at least one isolator and second valve means connected to said downstream side of said at least one isolator, one of said valve means being connected for selectively delivering a rinsing product from said at least one rinsing product supply and compressed air from said at least one compressed air supply to said at least one isolator, and the other of said valve means being connected for selectively placing said at least one isolator in communication with the waste recovery means before said isolator is placed in the isolating state.

2. Installation according to claim 1 wherein said at least one isolator is a mobile pipe member isolator having a movable pipe member which forms part of said circuit and which is movable by a distance sufficient to isolate said upstream circuit part from said downstream circuit part.

3. Installation according to claim 2 wherein said at least one isolator comprises a first isolator interconnected by means of respective valves between a grounded upstream storage tank and said at least one auxiliary storage tank, means being provided for transferring coating product from said upstream storage tank to said at least one auxiliary storage tank via said first isolator.

4. Installation according to claim 3 further comprising a second isolator interconnected between said at least one rinsing product supply and said at least one compressed air supply on its upstream side and between said first isolator and said at least one auxiliary storage tank on its downstream side.

5. Installation according to claim 4 further comprising a third isolator interconnected between a solvent supply on its upstream side and said at least one sprayer on its downstream side.

6. Installation according to claim 3 wherein said first isolator at least comprises a simple mobile rigid tube adapted to be connected in a fluid-tight manner to a fixed pipe end-piece.

7. Installation according to claim 4 wherein at least said first and second isolators are combined in a single structure provided with common actuator means to operate them simultaneously.

8. Installation according to claim 4 wherein said second isolator comprises a coupling member and shut-off valves between which said coupling member is connected.

9. Installation according to claim 5 wherein said third isolator comprises a coupling member and shut-off valves between which said coupling member is connected.

10. Installation according to claim 1 further comprising a coating product change unit connected to said upstream circuit part and to a plurality of coating product supplies.

11. Electrostatic spraying installation for continuous spraying of a conductive coating product, comprising: a power supply for supplying a high voltage; a coating product sprayer connectable to said supply to be placed at the high voltage; and a distribution circuit connected for distributing fluids including said conductive coating product, said distribution circuit being composed of an upstream circuit part adapted to be permanently grounded, an intermediate circuit part including an intermediate storage tank for storing said coating product, a downstream circuit part adapted to be placed at the high voltage, said downstream circuit part being connected for supplying said coating product to said sprayer and including a downstream storage tank for storing said coating product to be supplied to said sprayer, an upstream isolator connected between said upstream circuit part and said intermediate circuit part for electrically isolating said upstream circuit part from said intermediate circuit part, a downstream isolator connected between said intermediate circuit part and said downstream circuit part for electrically insulating said intermediate circuit part from said downstream circuit part, at least one rinsing product supply, at least one compressed air supply, and valve means including first valve means and second valve means, said first valve means being connected to each said isolator for selectively delivering a rinsing product from said at least one rinsing product supply and compressed air from said at least one compressed air supply to each said isolator, and said second valve means being connected to each said isolator for permitting rinsing product to exit each said isolator, wherein: said upstream circuit part comprises purge means and at least one said rinsing product supply means connected to said upstream isolator via said valve means; said intermediate circuit part further comprises a first rinsing product storage tank connected by said valve means to each of said isolators and a waste storage tank connected by said valve means to each of said isolators; and said downstream circuit part further comprises a second rinsing product storage tank connected by said valve means to said downstream isolator.

12. Installation according to claim 11 wherein each said isolator has a part which is movable to place that isolator in an isolating state and said valve means are operative for delivering rinsing product to, and permitting rinsing product to exit from, each said isolator before that isolator is placed in the isolating state.

13. Electrostatic spraying installation or spraying a conductive coating product, comprising: a coating product supply; at least one rinsing product supply; at least one compressed air supply; a power supply for supplying a high voltage; a coating product sprayer connectable to said power supply to be placed at the high voltage; and a distribution circuit connected for distributing fluids including said conductive coating product, said distribution circuit being composed of two branches and means connecting said two branches in parallel between said coating product supply and said sprayer, wherein each of said distribution circuit branches comprises: an insulated coating product storage tank; an upstream isolator connected between said storage tank and said coating product supply for electrically isolating said storage tank from said coating product supply; a downstream isolator connected between said storage tank and said sprayer for electrically isolating said storage tank from said sprayer; and valve means including first valve means and second valve means, said first valve means being connected to each said isolator for selectively delivering a rinsing product from said at least one rinsing product supply and compressed air from said at least one compressed air supply to each said isolator, and said second valve means being connected to each said isolator for permitting rinsing product to exit each said isolator, wherein said upstream isolator and an outlet of said storage tank in each said branch are connected by valves to a purge isolator.

14. Installation according to claim 13 further comprising an isolator connecting said at least one of said rinsing product and compressed air supplies to said sprayer through valves.

15. Installation according to claim 13 wherein, in each of said distribution circuit branches, said upstream isolator has a part which is movable to place said upstream isolator in an isolating state, and said valve means are operative for delivering a rinsing product to, and permitting rinsing product to exit from, said upstream isolator.

* * * * *